US006173458B1

(12) United States Patent
Maddux

(10) Patent No.: US 6,173,458 B1
(45) Date of Patent: Jan. 16, 2001

(54) PORTABLE SELF CONTAINED SINK AND WATER STORAGE CART

(75) Inventor: Larry D. Maddux, Westminster, CA (US)

(73) Assignee: Cambro Manufacturing Company, Huntington Beach, CA (US)

( * ) Notice: Under 35 U.S.C. 154(b), the term of this patent shall be extended for 0 days.

(21) Appl. No.: 09/262,179

(22) Filed: Mar. 3, 1999

(51) Int. Cl.[7] ..... A47K 1/00
(52) U.S. Cl. ..... 4/626; 4/625; 4/630; 4/619
(58) Field of Search ..... 4/619, 625, 626, 4/516, 624, 630; 312/311, 312, 330.1, 350, 236; 211/126.15; 392/441, 444, 451

(56) References Cited

U.S. PATENT DOCUMENTS 3,192,537 * 7/1965 Coffman et al. ..... 4/516
3,906,744 * 9/1975 Knapp et al. ..... 62/384
4,354,094 * 10/1982 Massey et al. ..... 219/306
4,356,967 * 11/1982 Lunick ..... 237/14
4,457,140 * 7/1984 Rastelli ..... 62/261
4,844,944 * 7/1989 Graefe et al. ..... 428/357
4,898,091 * 2/1990 Rozak et al. ..... 99/336
4,974,500 * 12/1990 Boyd et al. ..... 99/279
5,020,565 * 6/1991 Hattori et al. ..... 137/207
5,460,441 * 10/1995 Hastings et al. ..... 312/298
5,465,438 * 11/1995 Allman et al. ..... 4/626
5,526,539 * 6/1996 Bower et al. ..... 4/516
5,702,115 * 12/1997 Pool ..... 280/47.35
5,813,063 * 9/1998 Watkins et al. ..... 4/626
5,953,981 * 9/1999 Lassota ..... 99/281

* cited by examiner

*Primary Examiner*—Henry J. Recla
*Assistant Examiner*—Huyen Le
(74) *Attorney, Agent, or Firm*—George F. Bethel

(57) ABSTRACT

A portable sink having a sink module and a hot and cold water outlet connected to a spigot and a used water outlet from said sink connected to a cabinet mounted on wheels having at least one door to access the interior thereof. At least one tank for fresh water and a reservoir for used water is mounted in the cabinet. An electrical connection for powering a pump and a heater connected to the outlet of the pump has an outlet connected to the hot water outlet and a connection from the pump to the cold water outlet. A hammer arrester diminishes line surges and fluidic pounding from the pump, and a flow check valve prevents back flow to the fresh water tank.

3 Claims, 4 Drawing Sheets

PORTABLE SELF CONTAINED SINK AND WATER STORAGE CART

BACKGROUND OF THE INVENTION

1. Field of the Invention

The field of this invention resides within the field of food dispensing and water dispensing portable kiosks, bars, and related items. It more particularly involves those types of beverage dispensing carts and portable cafes that are used to provide various fast food items in a portable manner. To this extent it involves the washing and maintenance of food service items and the hands and other portions of a food service operator in order to maintain a degree of cleanliness in the dispensing of food.

2. Prior Art

The prior art with regard to food dispensing and cleanliness pertaining thereto has not been addressed with regard to outdoor and portable food dispensing carts. Such food dispensing carts are becoming more popular in such areas as corporate locations, office environments, malls, and shopping areas. Such food carts are sophisticated at this point wherein they can provide multiple prepared foods and beverages as well as limited food preparation on the cart.

In order to provide such food preparation and cleanliness, the health authorities have generally requested and in many cases demanded that the purveyor of such food have access to health facilities and in particular an area where they can wash their hands. Many times to date, the food dispensing carts had to be in an area where a building with restroom facilities or sinks provided such cleaning and sanitary conditions. As can be appreciated, this created an inconvenience and a problem for those dispensing and purveying food.

This invention solves the problem by providing a portable sink for cleanliness and health. The sink specifically has a fresh water source and a reservoir for the used water which is referred to as gray water. The sink has a faucet with hot and cold running water, the hot water being provided through a heater. Additionally thereto, an electrical outlet provides for heating and pumping of the water on a continuum. Further enhancement, of the overall health facilities provided by the sink is enhanced by a towel dispenser and a soap dispenser.

The entire unit is a portable unit and can be moved on casters or wheels. It is of a light weight plastic material which allows for not only portability but ease of handling. Further to this extent, the invention has ease of maintenance and operating capabilities not known in the prior art.

SUMMARY OF THE INVENTION

In summation, this invention comprises a portable sink with hot and cold running water having a fresh water supply, a heater, a pump, and certain regulators and controls for allowing the flow of hot and cold water from a spigot into a sink and for further retention by a reservoir after use.

More specifically, the invention comprises a portable sink mounted on rollers or casters. The housing and mounting includes a separable sink portion and cabinet portion. The sink portion has a sink, soap dispenser, faucets, and a spigot for hot and cold water.

The cabinet is mounted on wheels and houses four tanks of water, two of which are fresh water tanks and the other two are used water or gray water tanks.

In order to heat the water, an electrical inlet provides heat through a switch outlet box to a heater having heater coils and controls. The heater is supplied by water from the fresh water tanks through a pump under pressure. In order to provide for safety, a bypass valve or blow tube compensates for over pressure.

The pump also provides cold water to the spigot outside of the circuit of the water heater for an appropriate mixture of hot and cold water through the spigot.

In order to provide for and compensate as to pressure irregularities and pumping irregularities, a hammer arrester is placed in the line. The hammer arrester leading from the pump allows for absorption of pressure irregularities through the arrester so that a smooth and moderated transit of water takes place as delivered from the pump.

The water heater and controls including the switch outlet and pump are mounted on a water heater rack and control panel. The water heater rack and control panel can be removed for servicing, giving it ready access to a user. Further to this extent, the fresh water tanks and gray water tanks can be moved and rotated from their respective positions in an easy and facile manner by merely opening the front doors of the sink cabinet.

DESCRIPTION OF THE PREFERRED EMBODIMENTS

Figure 1:
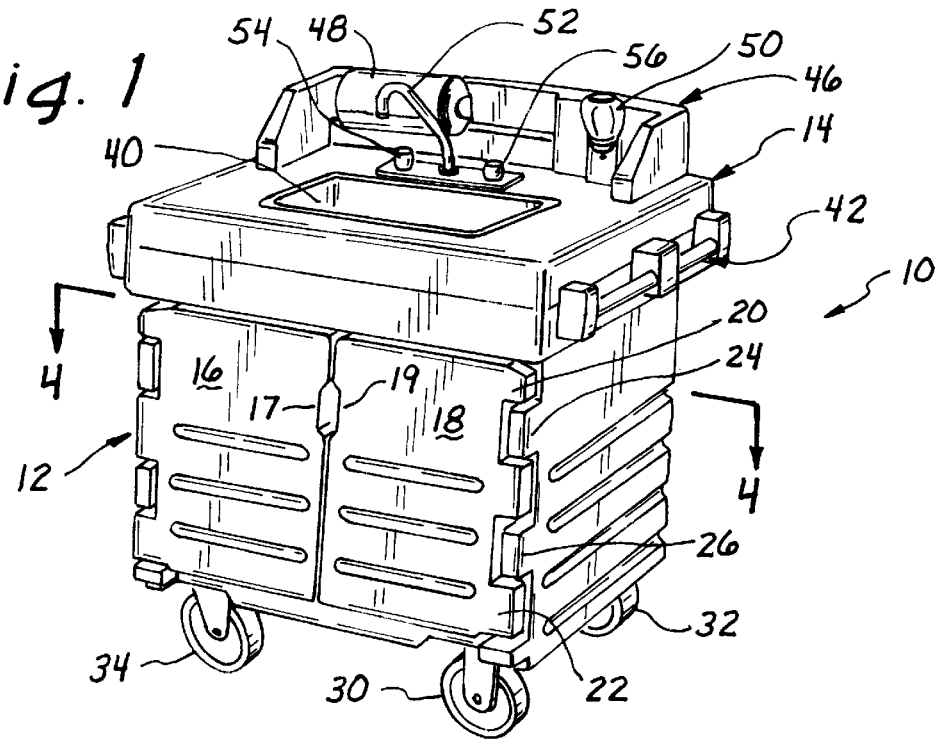
FIG. 1 shows a frontal perspective view of the sink and cabinet of this invention.

Looking specifically at FIG. 1 it can be seen that a cart 10 has been shown with a cabinet portion 12 and a sink portion 14. The cabinet portion 12 and the sink portion 14 can be referred to also as the cabinet module and the sink module.

The cabinet module has two doors 16 and 18. The two respective doors 16 and 18 are supported on hinge points that can be seen in the way of hinge elements at the upper and lower portions in the form of elements or knuckles 20 and 22. These respective hinge elements or knuckles have an intermediate hinge portion between them, and on the cabinet itself as opposed to the doors, formed as intervening hinge portions 24 and 26.

The hinge elements 20 and 22 are supported by a three inch long pin at the bottom namely through hinge portion 22 to the respective cabinet, and with a lock clip. A pivot pin is also inserted through portions 24 and 26 as well as in portion 20 to effectuate a hinge element so that the doors 16 and 18 can be opened and closed.

Doors 16 and 18 are frictionally secured with a hook and striker to allow them to be retained in closed relationship to the cabinet 12. A pair of opening handles 17 and 19 are cut into the doors 16 and 18 to allow easy access by merely positioning one's hand and pulling the openings.

The cabinet 12 is supported by four wheels or casters, two of which are wheels 30 and 32. Wheels 30 and 32 are stationary rigid casters. A pair of swivel wheels 34 and a second swivel wheel in a like position which is not seen also supports the cabinet. These respective swivel wheels have a brake element which can be seen in FIG. 2 in the form of the little brake pedal 36 that can be pressed downwardly to prevent the wheels 34 from turning. The wheels and casters can be of any configuration but are shown supported by brackets. These brackets can be substituted, and the wheels 30 and 34 supported in any other suitable manner.

The sink module 14 has a stainless steel two cavity sink 40 that is within the sink module. The sink module has a standard stopper in the form a basket stopper and is drained as will be seen hereinafter through a line to the used or gray water tanks. The sink module incorporates handle areas 42 supported by brackets extending from the sink module 14. The handle areas 42 can be locked to a kiosk of the type that is shown in Design Patent Application Serial No. 29/091,005 and connected as an entire unit. This effectively allows for a food server and a sink to be placed in connected relationship. Also, the handles 42 can be not only locked to a service cart but can be used independently as a towel rack.

At the back of the sink module 14 is a raised apron 46. The raised apron 46 circumscribes the sink in part to protect from back splashing as well as supporting a towel rack 48 and a soap dispenser 40. This allows one to use the sink with soap and water while later drying ones hands. The back splash panel or apron can be formed in any suitable manner such as a cowling or in the U shaped configuration around the sink module 14 as shown.

Attached to the sink module 14 is a spigot 52 and a hot water faucet 54 and cold water faucet 56 both with connections to a source of water. These respective faucets 54 and 56 allow water to pass from the spigot 52 into the sink area for washing ones hands.

Figure 2:
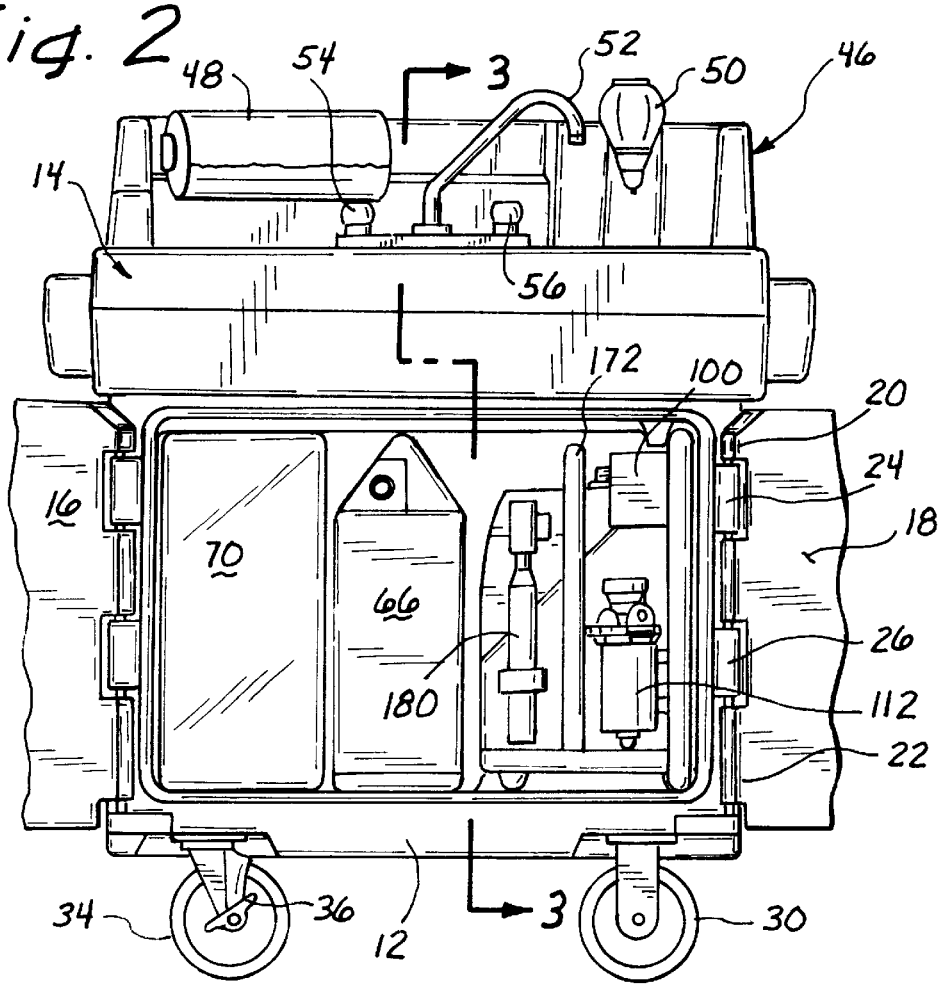
FIG. 2 shows a front elevation view of the sink and cabinet with the doors opened and fragmented.
Figure 3:
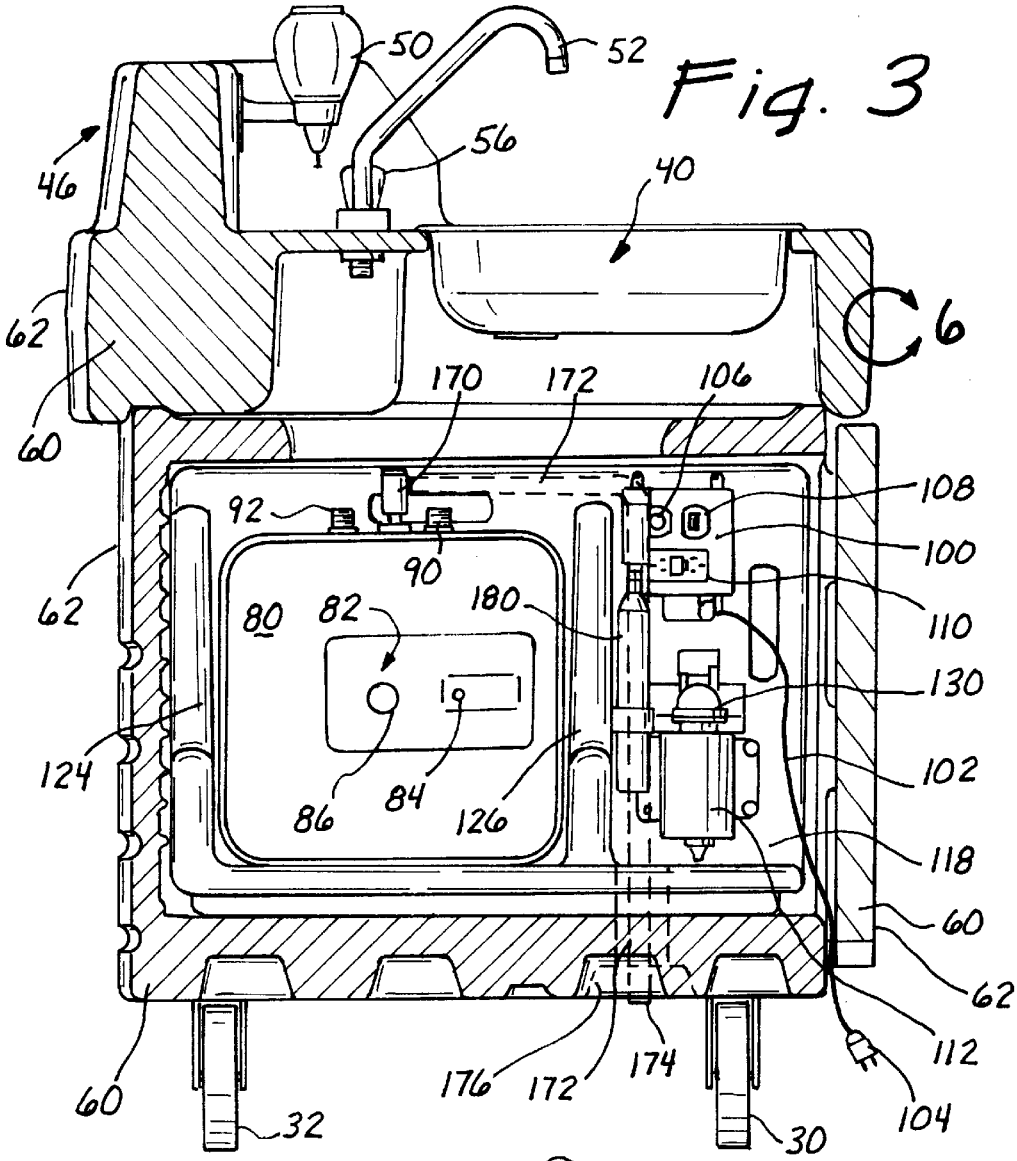
FIG. 3 shows a sectional view of the sink and cabinet detailing the area of the water heater controls and other portions as seen in the direction of lines 3—3 of FIG. 2.

Looking more specifically at FIGS. 2 and 3 it can be seen that the sink module 14 and the cabinet 12 have been formed as two respective portions. These two respective portions are formed by rotational molding and then attached at a later point in time. As can be understood, this provides for an ease of molding as well as attachment and dis-attachment of the two respective portions namely sink module 14 and cabinet 12. It also provides for access downwardly into the interior of the cabinet and the equipment therein.

Figure 6:
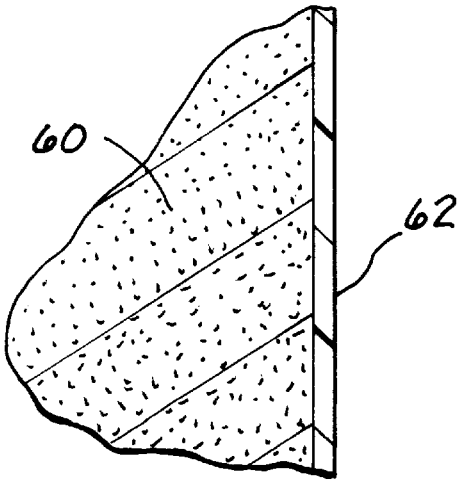
FIG. 6 shows a detailed view of the side wall of the cabinet and structure as seen through circle 6 of FIG. 3.

The respective rotational molding operation is such wherein it provides for a polyeurethane foam as can be seen in FIG. 6 namely urethane foam 60 with a polyethylene surface 62. The polyethylene surface 62 and foam can be utilized in any particular manner so as to effect a firm and rigid sandwich structure forming the entire cabinet and sink module. Other foam sandwich configurations, wall configurations and materials instead of the polyethylene material for the wall surface can be utilized. Also, it should be understood that the polyeurethane foam core namely polyeurethane foam 60 provides for stiffening as well as insulation and sound absorption.

Figure 5:
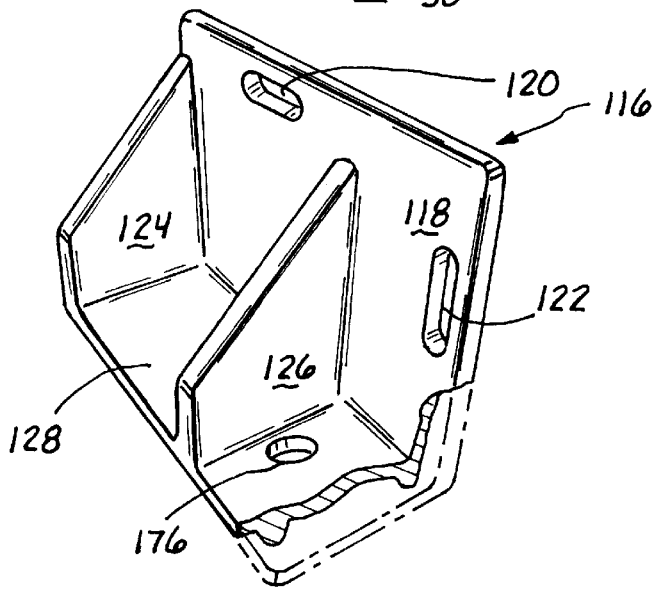
FIG. 5 shows a perspective view, as partially sectioned through one of its walls, of the water heater rack and control rack which can be removed from the cabinet.
Figure 4:
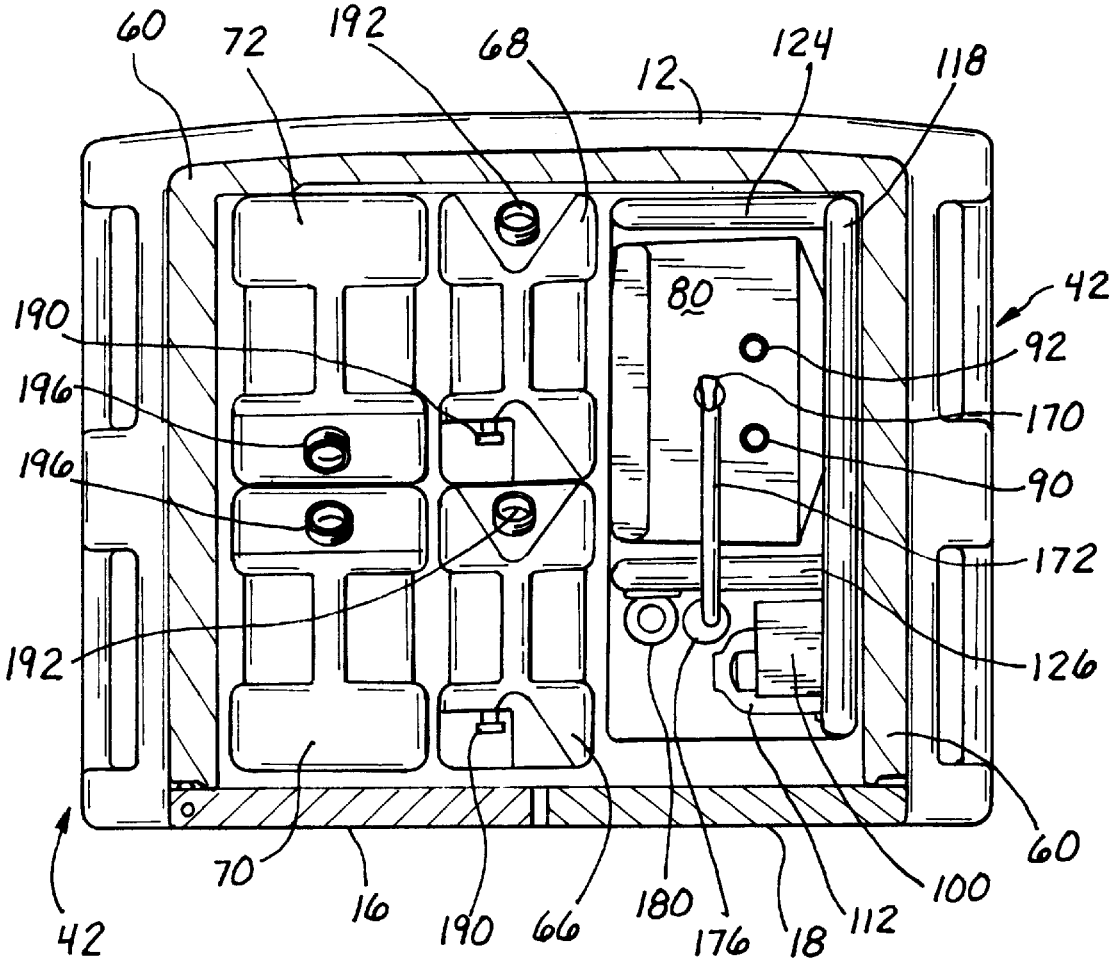
FIG. 4 shows a sectioned top plan view of the water tanks and the heater and controls as seen in the direction of lines 4—4 of FIG. 1.

Looking again more specifically at FIGS. 3, 4, and 5 it can be seen that the cabinet area has a total of four tanks. Specifically, a pair of fresh water tanks 66 and 68 are shown on the right side of FIG. 2. Used water tanks 70 and 72 are shown to the left side. The two respective tanks 70 and 72 can be referred to as gray water tanks after use of the water. The respective tanks 66 and 68 are connected for pumping water for cold water usage as well as hot water usage in the manner that will be described hereinafter. The foregoing tanks 66, 68, 70, and 72 comprise the fresh water reservoirs respectively and used water reservoirs and must be filled and removed respectively after their contents have been utilized and filled.

Looking more specifically at FIGS. 2 and 3, it can be seen that a water heater 80 has been shown. The water heater 80 has a control panel 82 with an on/off switch 84 and a dial 86 for purposes of controlling temperature. This respective control panel 82 allows the water heater 80 to maintain hot water in the system.

The water heater 80 can be made of a plastic exterior surface with foam cell material for insulating the heater. It has a heater element interiorly thereof which can be in a metal or stainless container. It can be a metal tank or it can be stainless with the heating element passing therethrough on the interior portion of the heater 80. The heater element can be a looped wire coil or any other type of known electrical element wherein a passage of water therethrough is heated by either an electric heating element or other means of electrical heating to heat the water passing through the coil.

An inlet connection 90 and outlet 92 is provided for the water passing into the heater 80 to be heated and then passed to the hot water outlet, which is controlled by the hot water faucet and inlet 54.

In order to control the unit electrically, a switch outlet box 100 is shown having a cord 102 connected thereto and a plug 104. This provides power to the system. The switch outlet box 100 has a light 106 to indicate when the unit is on and a switch 108 which provides the function of being an on/off switch. Two respective outlets shown as a duplex outlet 110 provide the outlet for plugging in the pump to be referred to hereinafter and the heater 80.

A pump 112 is shown mounted by four bolts to the water heater and mounting rack 116. The water heater and mounting rack 116 is shown with a side wall 118 having a lifting handle 120 and a sliding or pulling handle 122. The rack 116 has two bracing walls 124 and 126 that are connected to a bottom portion 128.

Pump 112 as previously stated is mounted to the rack 116 and specifically on the wall 118, by the four respective bolts.

The pump 112 fundamentally is of a diaphragmatic type having an electrically powered diaphragm that is within the general area 130.

The heater 80 has been provided with what can be referred to as a flow and pressure relief system in the form of a fluid connection 170. Relief is provided through a tube 172 or conduit that can be referred to as a blow tube that turns downwardly and terminates at an opening 174. An opening that is indexed thereto namely opening 176 is provided in the rack 116 so that tube 172 can pass therethrough. This allows for overflow or relief of any pressure therein through the tube 172.

In order to complete the water circuit, a hammer arrester or what can be referred to generally as a flow moderator for variable pressure flows has been provided, namely hammer arrester 180. The hammer arrester 180 is formed with an inlet 182 that allows the flow from the pump 112 to pass therethrough and then through an outlet 184. Interiorly of the hammer arrester 180 is a piston and cylinder that moderates the flow of water pressure surges. Water surges are accommodated and the commonly known effect of "hammering" in a water line is diminished.

In order to connect the outlets of tanks such as tanks 66 and 68, an outlet 190 is provided. These outlets 190 are such wherein they can be connected to hose couplings or other couplings so that flow can pass therethrough to the pump 112. In order to fill the tanks 66 and 68, inlets 192 are provided in each tank.

The used water or gray water passes into tanks 70 and 72 through inlets 196 at the top of each tank connected to the outlet of the sink.

In order to lift the tanks 66 and 70, handles 198 and 200 are provided respectively in tanks 66 and 70.

Figure 7:
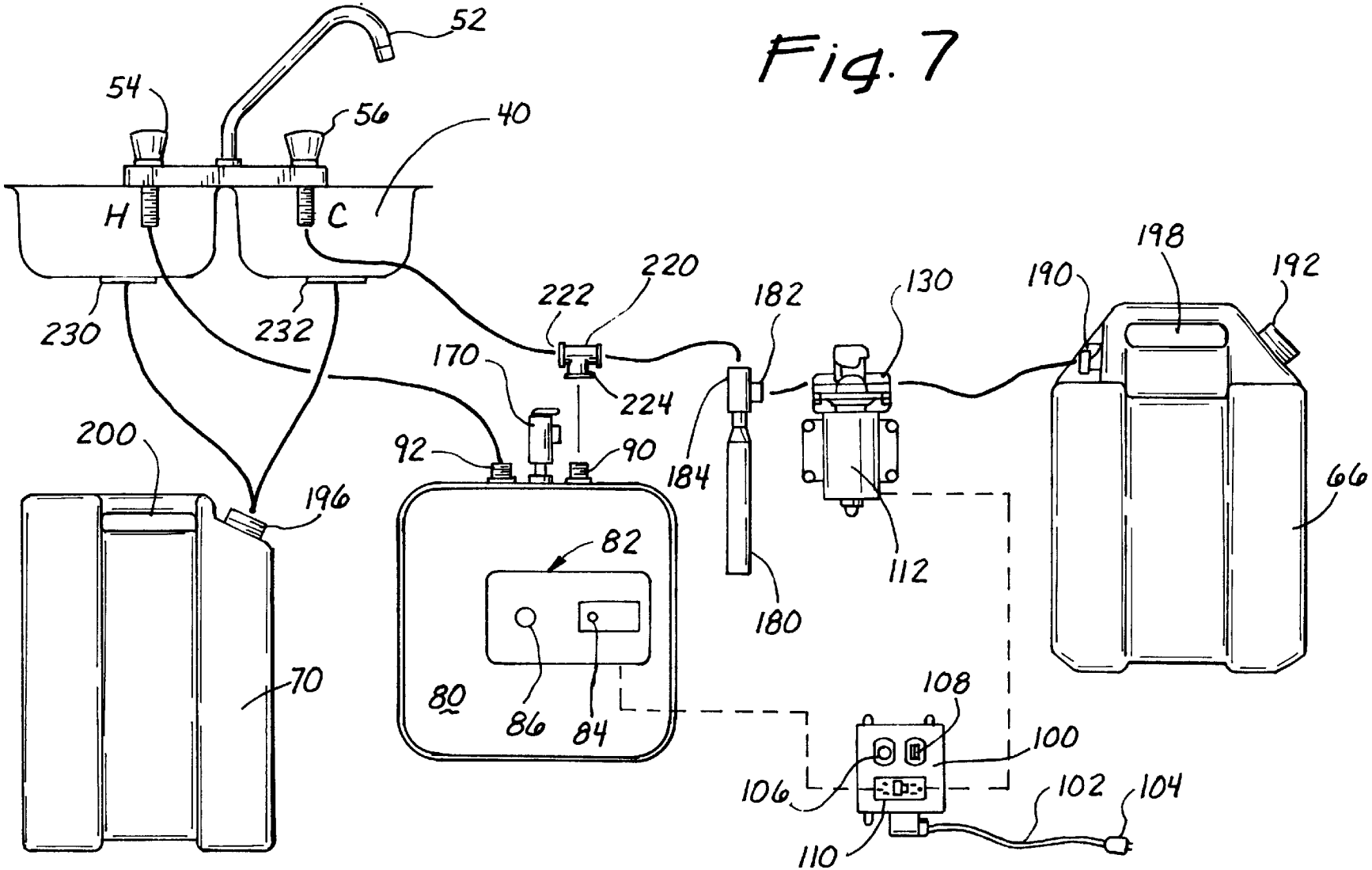
FIG. 7 shows a line diagram and schematic view of the water and control flow path.

Each respective tank and its connections such as connections 192 and 196 can be provided with a threaded coupling or any other means to connect a hose or outlet in the way of a conduit thereto. In particular, looking at FIG. 7, it can be seen that the outlet from tank 66 which is a five gallon fresh water tank is drawn or pumped from its outlet by pump 112. The outlet of pump 112 is then delivered through the inlet 182 of the hammer arrester 180. This tends to moderate and limit the line banging or "hammering" which could possibly happen through surges of the pump 112.

The outlet from the hammer arrester 180, namely outlet 184 is delivered to a T 220. The T 220 allows water to flow into the heater 80 while at the same time going to the cold water inlet and faucet 56. Water from the T 220 can be directed to the cold water connection 222 or to the hot water connection 224 after being heated. Furthermore, T 220 can be equipped with a non-reverse flow valve so that flow will not be allowed to flow back into the system. Also, connections to the tank outlets such as outlet 190 can be provided with a reverse flow function as well as other portions in the lines to prevent flow of any water back into the fresh water system.

The water from the hot portion of the T outlet namely outlet 224 flows into the inlet of the heater inlet 90. After it is heated it flows from outlet 92 of the heater to the hot water faucet and connection 54. Both connections obviously 54 and 56 are connected to the spigot 52. Outlet from the sink 40 can flow by gravitation through sink outlets 230 and 232 to the inlet 196 of the used or gray water tanks 70. Thus it can be seen that the entire circuit of the respective flow from the fresh water tanks 66 and 68 to the used or gray water tanks 70 and 72 provides for fresh water that can be used for washing purposes.

The unit is controlled and powered through the electrical connector namely electrical connector 100 which is in turn provided with a circuit breaker. It has an on/off switch 108 and a light 106 to indicate the on/off condition. Duplex outlets 110 provide the power to the respective pump 112 and to the heater 80 providing for the complete electrical circuit to allow the system to work.

Various sensors can be utilized to allow initiation of pumping such as when pressure drops, the pump 112 starts to pressurize the outlet as a consequence of pressure dropping through the opening of outlets 54 and 56 when the faucets are turned. Also, other sensors can be utilized to provide discrete inlets to the heater 80 or to the cold water circuit in any suitable manner. Various back flow and pressure relief members can be utilized throughout the system for preventing back flow and over pressurization.

From the foregoing, it can be seen that this invention is a substantial step over the art of providing for a portable sink to be used by the food service industry.

What is claimed is:

1. A portable sink to accompany food and beverage service comprising;

a cabinet with a sink attached thereto said sink having at least one faucet;

an electrical connection for connection to an external source of power;

a pump for attachment to said electrical connection;

a source of fresh water;

a reservoir for used water;

connection conduits between said pump, and said fresh water source;

a connection conduit between said pump and said faucet for delivering fresh water to said faucet when said pump is turned on;

conduit means from said sink to said used water reservoir;

a hammer arrester in fluid connected relationship to said pump to diminish fluid surge pounding;

wheels mounted to said cabinet for movement of said sink and cabinet;

an electrical heater for providing hot water between said pump and said faucet;

said pump, heater, and electrical connection are mounted on a removable rack and cabinet walls formed from plastic molded walls having a foam core.

2. A portable sink comprising:

a sink portion having at least one faucet;

a cabinet portion mounted on wheels said cabinet portion having walls;

a source of fresh water adapted for placement in said cabinet;

a reservior adapted for placement in said cabinet for receiving used water;

a pump for pumping fresh water from said source of fresh water to said faucet;

a conduit to conduct water from said sink to said used water reservior;

a heater connected to said fresh water source for heating water flowing to said faucet;

an electrical connector to connect said heater and pump to a source of electrical power external to said portable sink; p1 said cabinet portion walls are formed from plastic molded walls having a foam core;

temperature controls for regulating said heater;

a hammer arrester in fluid connected relationship to said pump to diminish surges and pounding in the line connected to said heater and faucet; and, a removable rack to which said heater and pump are mounted.

3. A portable sink comprising:

a sink module having a sink and a hot and cold water outlet connected to at least one faucet and a used water outlet from said sink;

a cabinet mounted on wheels connected to said sink having at least one door to access the interior thereof;

at least one tank for fresh water and a reservior for used water mounted in said cabinet;

an electrical connection for connecting said sink to a source of power removed from said sink;

a pump;

means for connecting said pump to said electrical connection and fluidically to said fresh water tank;

a heater connected to the outlet of said pump having an outlet connected to said faucet;

means to connect said pump to said cold water outlet;

a removable rack to which said heater and pump are mounted;

a hammer arrester for diminishing line surges and fluidic pounding from said pump;

a flow check valve to prevent back flow to said fresh water tank and cabinet walls formed from plastic molded walls having a foam core.

* * * * *